US008196620B2

(12) United States Patent
Fransen

(10) Patent No.: US 8,196,620 B2
(45) Date of Patent: Jun. 12, 2012

(54) BAG VALVE

(75) Inventor: Alfons Jozef Fransen, Bornem (BE)

(73) Assignee: Ecopack France S.A.S., Briey (FR)

( * ) Notice: Subject to any disclaimer, the term of this patent is extended or adjusted under 35 U.S.C. 154(b) by 1021 days.

(21) Appl. No.: 12/159,314

(22) PCT Filed: Dec. 28, 2006

(86) PCT No.: PCT/EP2006/012564
§ 371 (c)(1),
(2), (4) Date: Jun. 26, 2008

(87) PCT Pub. No.: WO2007/077003
PCT Pub. Date: Jul. 12, 2007

(65) Prior Publication Data

US 2008/0314475 A1 Dec. 25, 2008

(30) Foreign Application Priority Data

Dec. 30, 2005 (FR) ..... 05 54155

(51) Int. Cl.
*B65B 3/04* (2006.01)

(52) U.S. Cl. ..... 141/114; 141/3; 141/10; 141/20; 141/313

(58) Field of Classification Search ..... 141/3, 10, 141/20, 114, 313–314, 316–317, 374
See application file for complete search history.

(56) References Cited

U.S. PATENT DOCUMENTS

| | | | | | |
|---|---|---|---|---|---|
| 3,731,854 | A * | 5/1973 | Casey | 222/386.5 |
| 4,032,064 | A * | 6/1977 | Giggard | 222/95 |
| 4,265,373 | A * | 5/1981 | Stoody | 222/94 |
| 4,346,743 | A * | 8/1982 | Miller | 141/3 |
| 4,383,399 | A * | 5/1983 | Stoody | 141/3 |
| 5,211,316 | A | 5/1993 | Adalberto et al. | |
| 5,505,039 | A * | 4/1996 | Maier | 141/20 |
| 5,730,326 | A * | 3/1998 | Kaeser | 222/95 |
| 5,799,469 | A * | 9/1998 | Obrist | 53/470 |
| 5,915,595 | A * | 6/1999 | Dow et al. | 222/95 |
| 6,085,945 | A * | 7/2000 | Fransen | 141/20 |
| 6,345,739 | B1 * | 2/2002 | Mekata | 141/20 |
| 6,375,046 | B1 * | 4/2002 | Alleard et al. | 141/20 |
| 7,523,767 | B2 * | 4/2009 | Pericard | 141/10 |

FOREIGN PATENT DOCUMENTS

| | | | |
|---|---|---|---|
| CH | 680 849 | A | 11/1992 |
| DE | 39 14 517 | A1 | 9/1990 |
| DE | 201 14 864 | U1 | 11/2001 |
| EP | 0 549 096 | A1 | 6/1993 |
| WO | 02-062678 | A1 | 8/2002 |
| WO | 02-062679 | A1 | 8/2002 |

OTHER PUBLICATIONS

International Search Report of PCT/EP2006/012564, date of mailing Mar. 27, 2007.

* cited by examiner

*Primary Examiner* — Gregory Huson
*Assistant Examiner* — Nicolas A Arnett
(74) *Attorney, Agent, or Firm* — Westerman, Hattori, Daniels & Adrian, LLP

(57) ABSTRACT

The improved bag valve includes a flexible bag (4) made of an impermeable material with an opening that is closed by a valve (6) for filling the bag (4) with a desired product. The empty bag (4) is rolled up or folded about a longitudinal axis (X-X') and kept in the rolled position. The bag (4) is designed so as to elongate itself when filled with the desired product.

16 Claims, 10 Drawing Sheets

BAG VALVE

BACKGROUND ART

The invention concerns an improved bag-on valve.

A bag-on valve is used in a distributor for a product under pressure such as for example an aerosol can.

A bag-on valve generally comprises a flexible bag made of impermeable material which is made for example of two synthetic layers placed on top of one another and welded together at their girth, whereby an opening is left which is closed by a valve making it possible to fill the bag with the desired product.

Such a bag-on valve is often rolled up or folded up, somewhat like a cigar, and it is maintained in the rolled-up position by a label glued round the rolled-up bag-on valve.

This rolled-up bag-on valve is then introduced in a recipient with an opening which is shut by the valve of the bag-on valve.

The distributor which is thus obtained by assembling the bag-on valve in the recipient is then filled with the product to be distributed on the one hand, which is introduced under pressure in the bag-on valve, and with a gas under pressure which fills the space formed between the recipient and the bag-on valve on the other hand and which serves as a pressure source for distributing the product when the valve is activated by means of a spray button mounted on the valve.

During the filling of the product, the label which maintains the bag-on valve in the rolled-up position is broken by the filling pressure of the product which makes the bag swell while unrolling or unfolding the bag.

The length of the rolled-up bag-on valve is chosen as a function of the height of the recipient, such that the length is equal to the height of the recipient, as a result of which it can contain a maximum quantity of the product.

Only, while filling it with the product, the length of the bag-on valve becomes shorter as the bag is being filled, since the bag swells and expands laterally, which is disadvantageous in that the filled bag does not rest on the bottom of the recipient and, as a result, the bag containing the weight of the product is completely suspended on the valve, which implies that the bag will easily tear if the distributor is dropped by accident.

When the bag is unrolled while being filled with the product, there will be another problem in that the bag often has two upper corners which extend laterally and which hinder the unrolling movement as these corners come into contact with the inner wall of the recipient, resulting in the bag being twisted round the valve.

On the one hand, this twisting of the bag makes the bag weak, such that the bag may tear due to the effect of the mere twist, or due to the fact that, because of the twist, the filling volume is not sufficient to contain the quantity of product that is injected in case of an automatic filling.

On the other hand, the weakening caused by the twist makes the bag tear quicker when the distributor falls on the ground.

A disadvantage connected to the use of the label for maintaining the bag-on valve in the rolled-up position is that this label hinders the unfolding of the bag, thus causing a twist during the filling phase, which results in a weakening as described above.

SUMMARY OF THE INVENTION

The invention aims to remedy one or several of the above-mentioned disadvantages and to provide a bag-on valve which allows for a guaranteed filling of a distributor containing such a valve, while reducing the risk of the bag being twisted and being torn during the filling phase of the recipient or in case of an accidental drop of the filled distributor.

This aim 1s reached according to the invention with an improved bag-on valve which comprises a flexible bag made of impermeable material and which is provided with an opening sealed by a valve which makes it possible to fill the bag with a desired product, whereby the empty bag is rolled up or folded round a longitudinal axis and is maintained in the rolled-up position, characterised in that the bag is provided with means making it possible to elongate the bag while it is being filled with the desired product.

In this way is obtained a bag which, as soon as it is filled, rests on the bottom of the recipient, which reduces the risk of the bag being torn in case of a fall.

These means which enable the bag to elongate during its filling are advantageously realised in that the bottom of the bag is folded towards the inside of the empty bag, thus forming flaps which can be turned up.

The shape of the upper part of the empty and unrolled bag is preferably conical, such that the width of the empty bag diminishes towards the location of the valve.

Thus, the shape of the bag is advantageous in that it does not hinder the unrolling or unfolding movement of the bag during the filling phase.

Another way to obtain this advantage would consist in folding the upper corners of the bag towards the inside before rolling up the bag.

The empty bag-on valve is kept rolled up or folded up by means of a label glued round the bag, whereby this label comprises one or several transversal lines with spaced perforations.

The effect of these perforations is that, during the filling phase, the label is torn at a precise spot, predetermined by the positioning of the perforations, thus reducing the risk of the bag being twisted during the filling.

The twisting risk of the bag is also reduced by providing a self-adhesive, rectangular label whose central part is only partially provided with an adhesive, whereby the adhesive is preferably provided in a zone in the shape of a sandglass.

Should the bag nevertheless be twisted after its filling, the product will be evacuated more easily while the distributor is in use thanks to a plunger tube whose length corresponds more or less to the length of the bag and which is preferably inserted at a tip of the valve.

This plunger tube is advantageous in that it promotes the evacuation of the product while the distributor is in use, even if the bag is not compressed in a symmetrical manner and a part of the product is shut up in a separate part of the bag, since the plunger tube creates an evacuation route through and round the plunger tube.

In the case of the plunger tube, the valve is preferably provided with two passages which communicate with the inside of the bag, whereby one passage opens in the plunger tube, and the other passage opens in the bag above the above-mentioned tip.

This promotes a quick filling of the bag as the product is injected via an extra passage, whereas the existing distributors only have a single passage.

In order to avoid leaks in the area where the bag is fixed to the valve, the body contour of the valve usually has an oval shape or the shape of a diamond. In order to reduce the twisting effect of the bag round the valve, the length of the body contour of the valve is preferably as small as possible, but at least the double of the width of said contour. This also makes it possible to pre-direct the body contour of the valve in the bag before the welding takes place at the production lines of these bag-on valves.

According to a preferred embodiment, the body of the valve comprises an inner part and an outer part, whereby both parts are made of two different materials, i.e. the inner part of a synthetic material which is impermeable to liquefied gases, and the outer part of a material which is fit for the welding of the inner coating of the bag made of PE or PP or another material.

This makes it possible to use liquefied gases as a propellant gas while maintaining the possibility to fix the bag tightly to the valve. The advantage of being able to use liquefied gases to eject the product while the distributor is in use, is that there is a constant compression pressure which practically does not diminish when the quantity of the product and the quantity of the gases diminish.

BRIEF DESCRIPTION OF THE DRAWINGS

The following examples of embodiments of an improved bag-on valve according to the invention are given as an example only without being limitative in any way, with reference to the accompanying drawings, in which.

DETAILED DESCRIPTION OF PARTICULAR EMBODIMENTS

Figure 1:
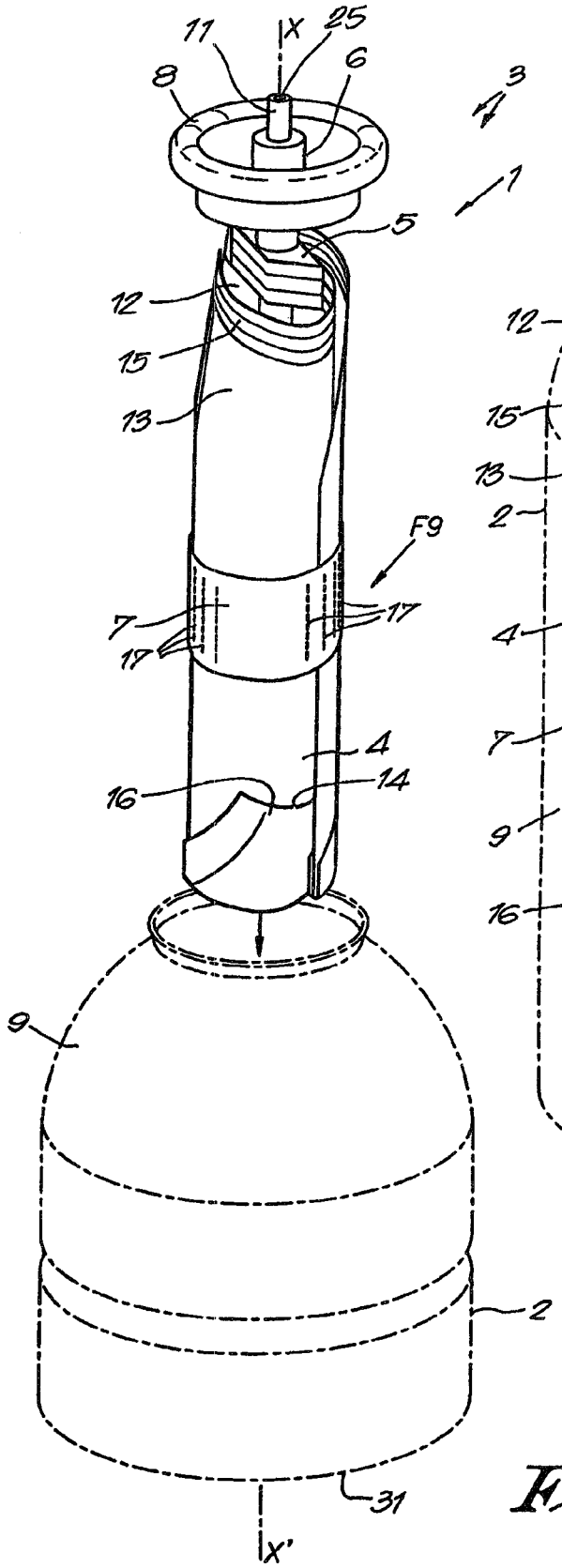
FIG. 1 is a view in perspective of an empty bag-on valve according to the invention.
Figure 2:
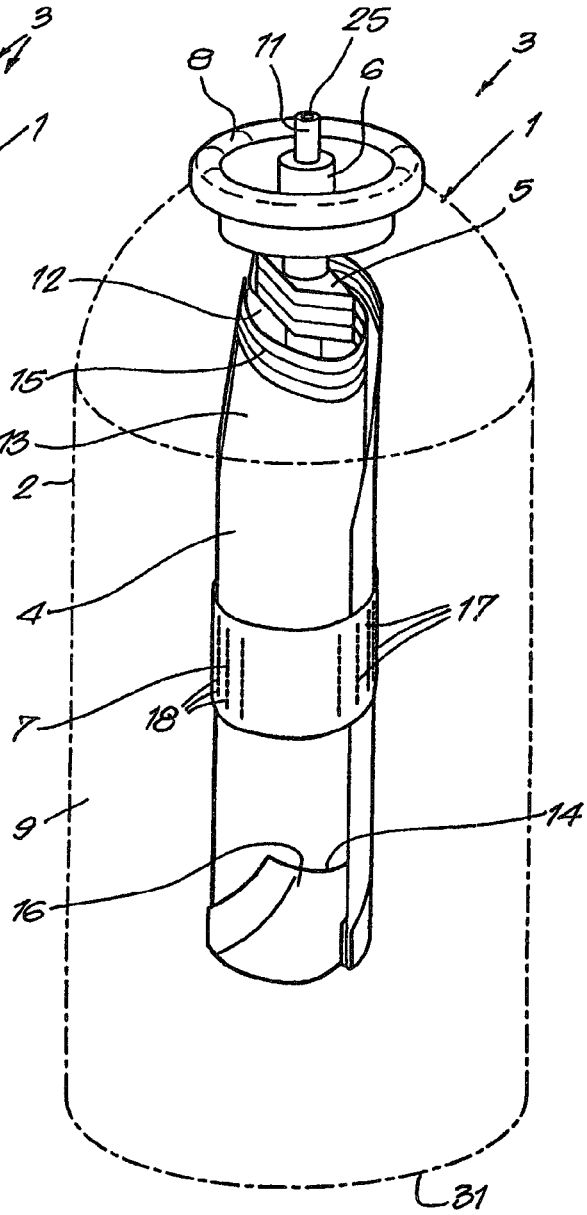
FIG. 2 represents the bag-on valve of FIG. 1, but when introduced in the recipient of a product distributor.

FIGS. 1 and 2 represent an improved bag-on valve 1 according to the invention, designed to be mounted in a recipient 2 of a product distributor as represented in FIG. 2.

The improved bag-on valve 1 comprises a flexible bag 4 made of impermeable material which is provided with an opening which is sealed by the body 5 of a valve 6 which makes it possible to fill the bag 4 with a desired product, whereby the empty bag 4 is rolled up or folded round a longitudinal axis X-X' and is maintained in the rolled-up position by a label 7 glued round the rolled-up bag 4.

In the given example, the valve is fixed to the recipient 2 by means of a mounting-cup 8 which serves as a plug for the recipient so as to create a closed compartment 9 between the recipient 2 and the bag 4 which may contain a propellant gas.

After the assembly of the bag-on valve 1 and the recipient 2, the bag 4 is filled under pressure with any desired product, whereas the compartment 9 is filled with a quantity of gas or liquefied gas.

Figure 3:
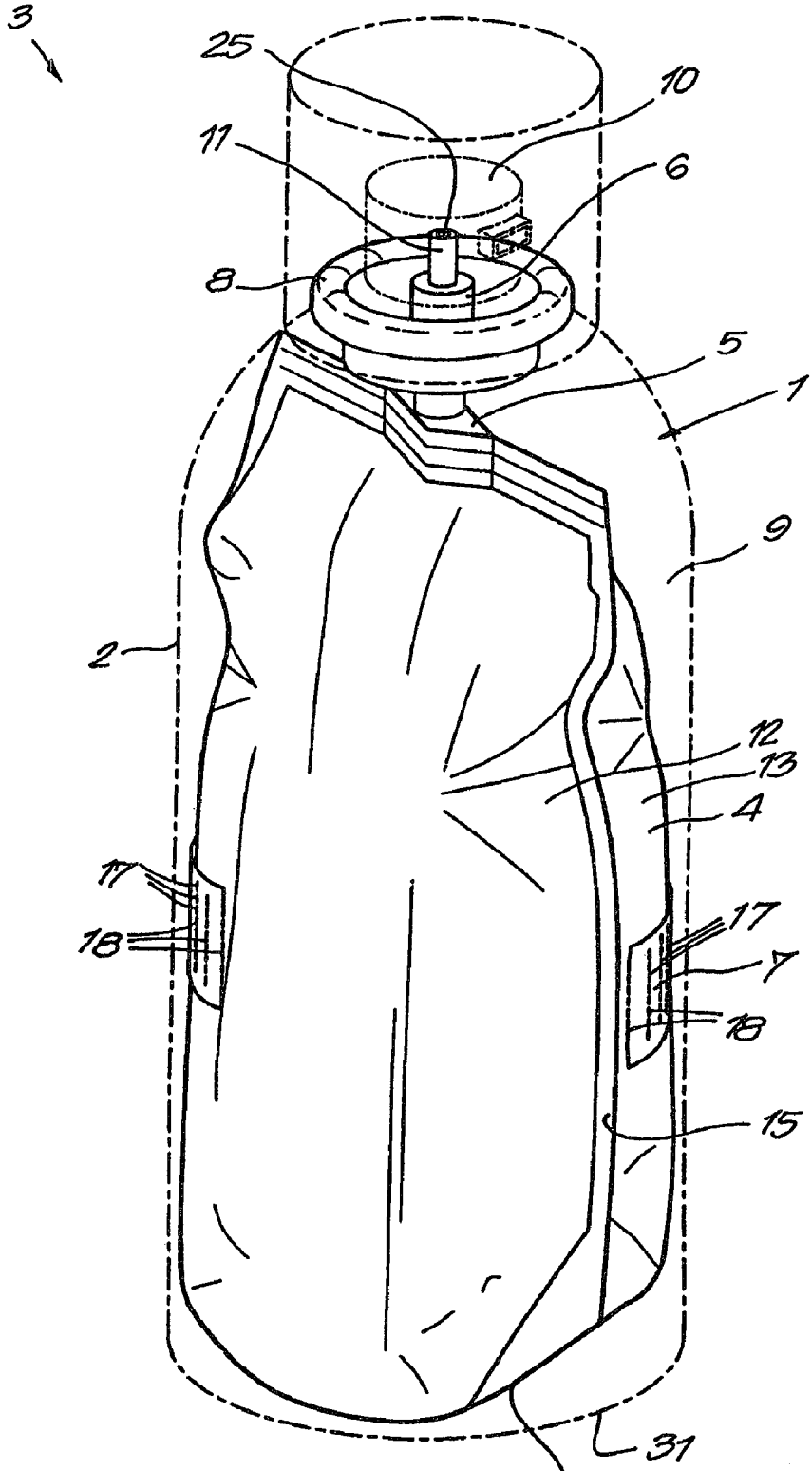
FIG. 3 represents the bag-on valve of FIG. 1, but after having been filled with a product.

The filling pressure of the product makes the bag 4 swell, as a result of which the label 7 is torn and the bag is unrolled round the axis X-X' as represented in FIG. 3.

After the filling, the distributor 3 is completed as illustrated in FIG. 3 by introducing a spray or distribution nozzle 10 which is mounted on the valve 6 by means of a valve stem 11 which makes it possible to eject the propellant gas under pressure and to atomize or distribute the product when pressing on the spray nozzle 10.

Figure 4:
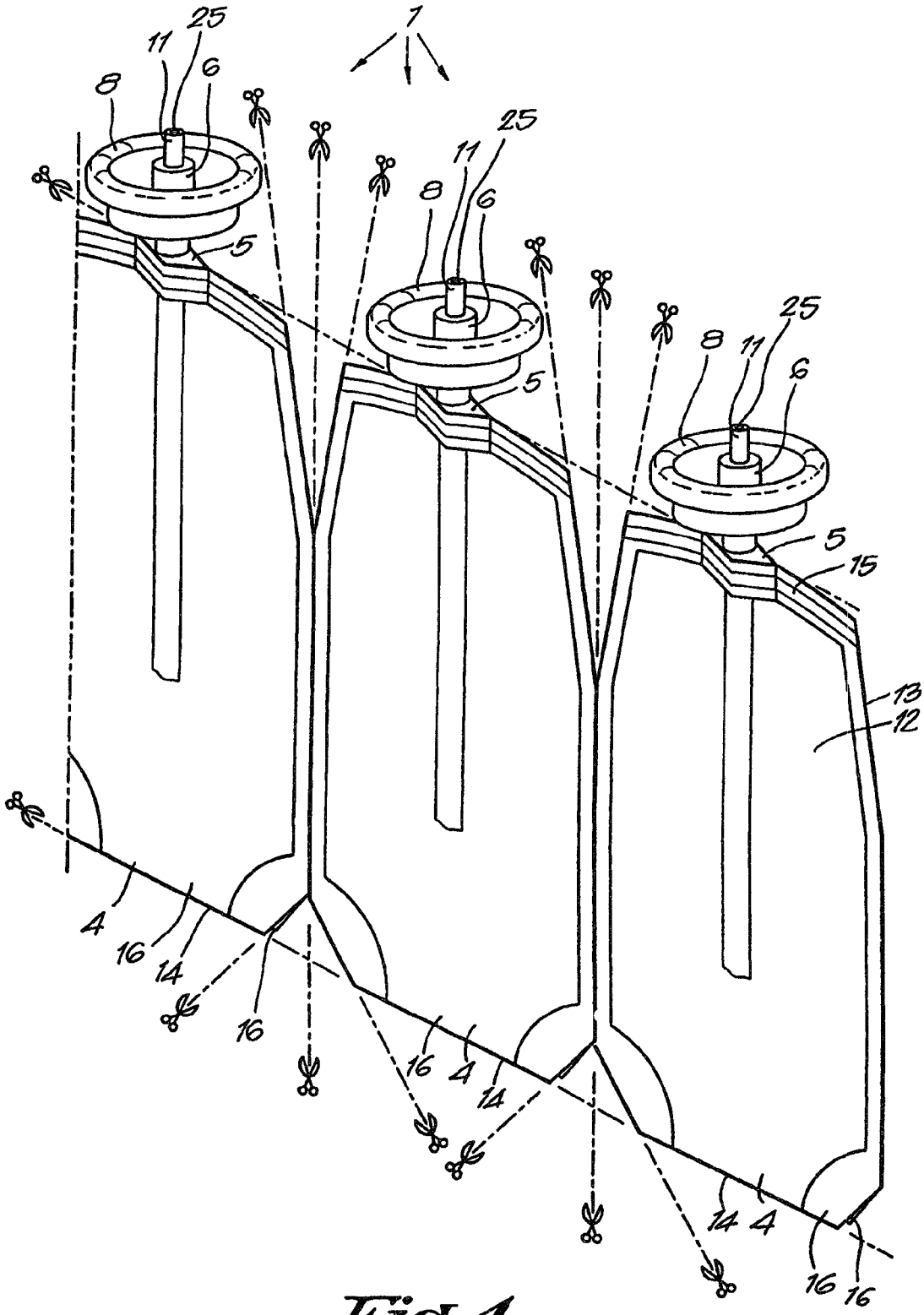
FIGS. 4 and 5 represent two production phases of a bag-on valve according to FIG. 1.

In general, bag-on valves are made in series, as represented in FIG. 4, after which they are cut apart.

Figure 5:
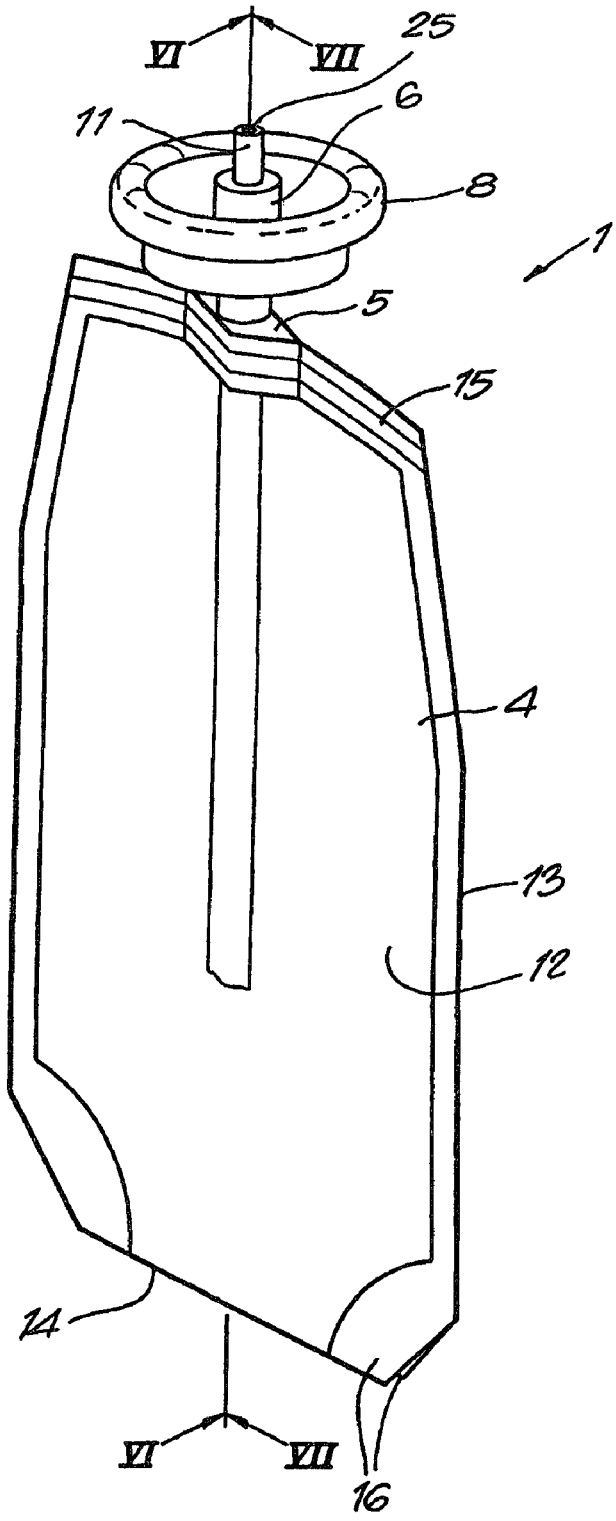
Figure 6:
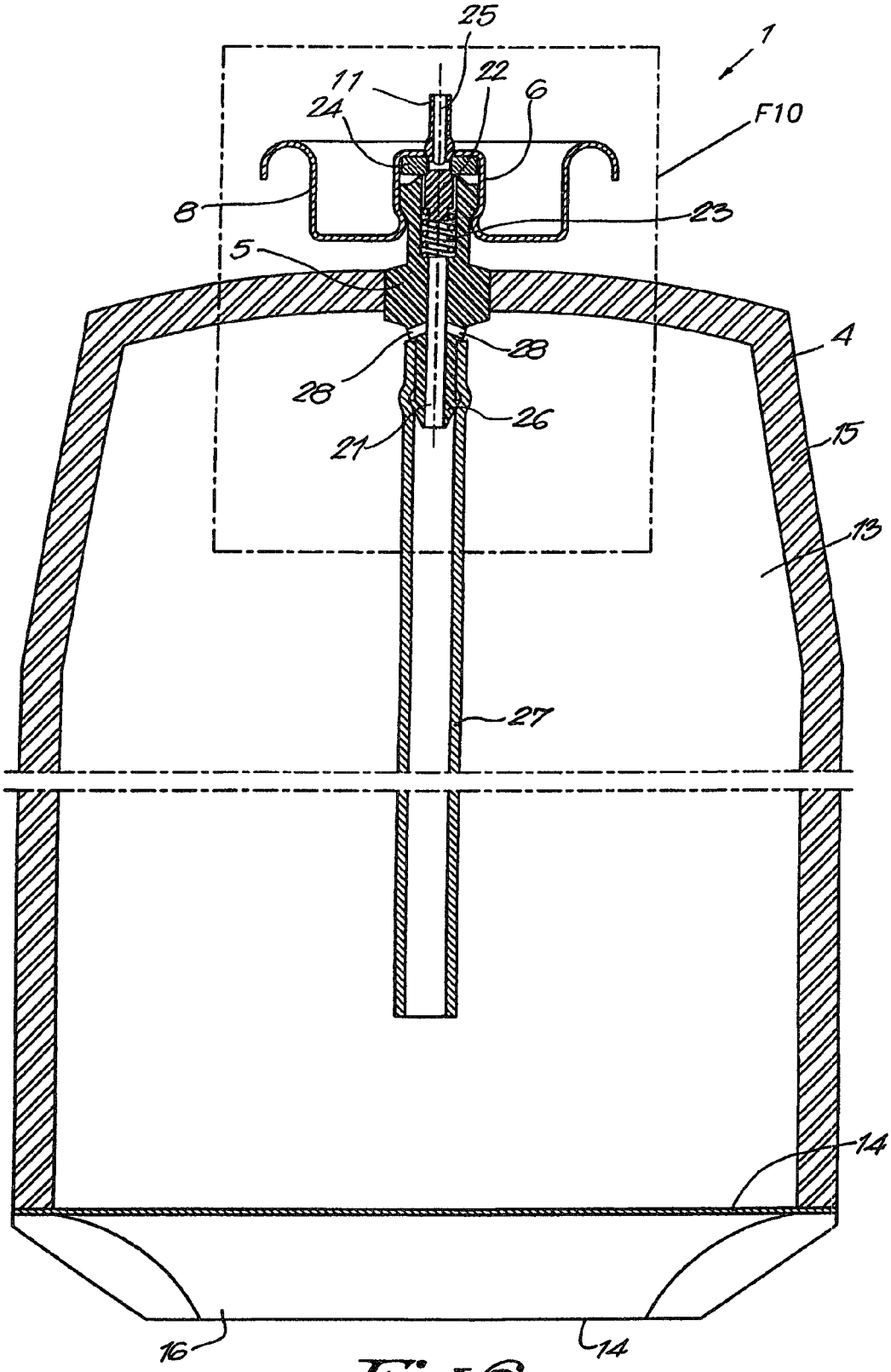
FIGS. 6 and 7 represent sections according to the lines VI-VI and VII-VII respectively of FIG. 5.
Figure 7:
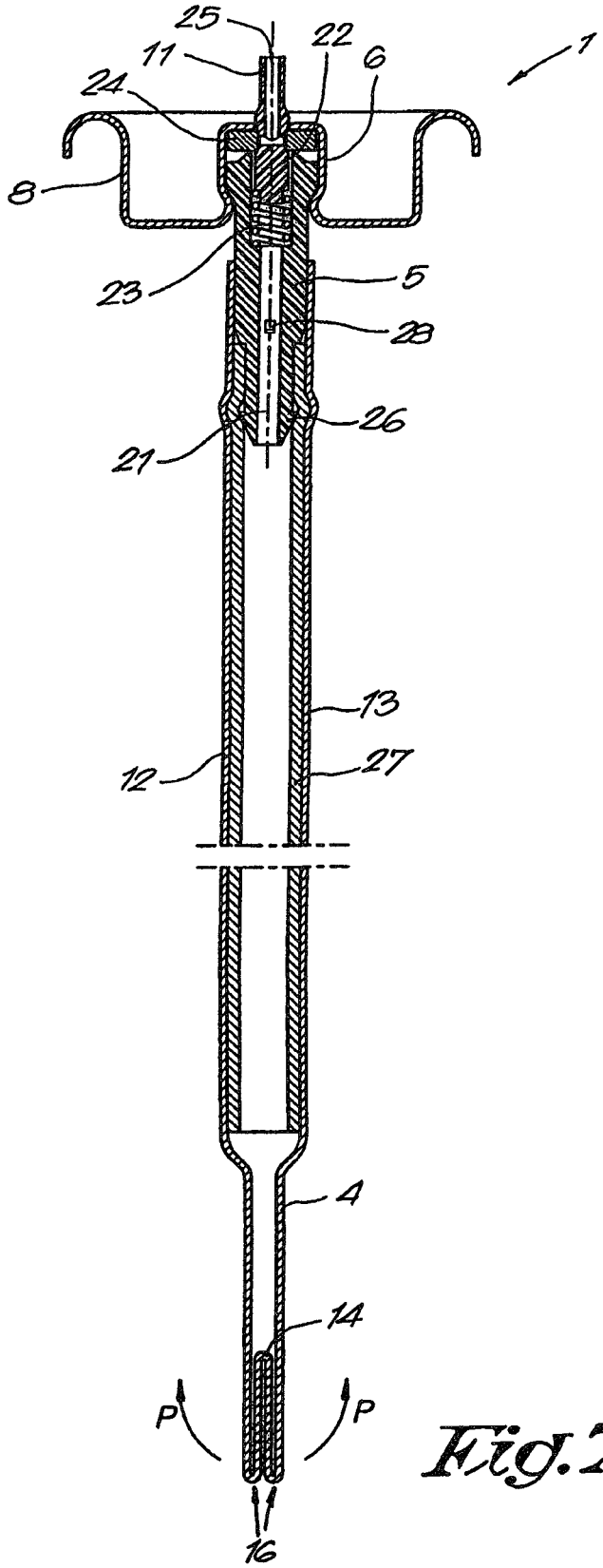
Figure 8:
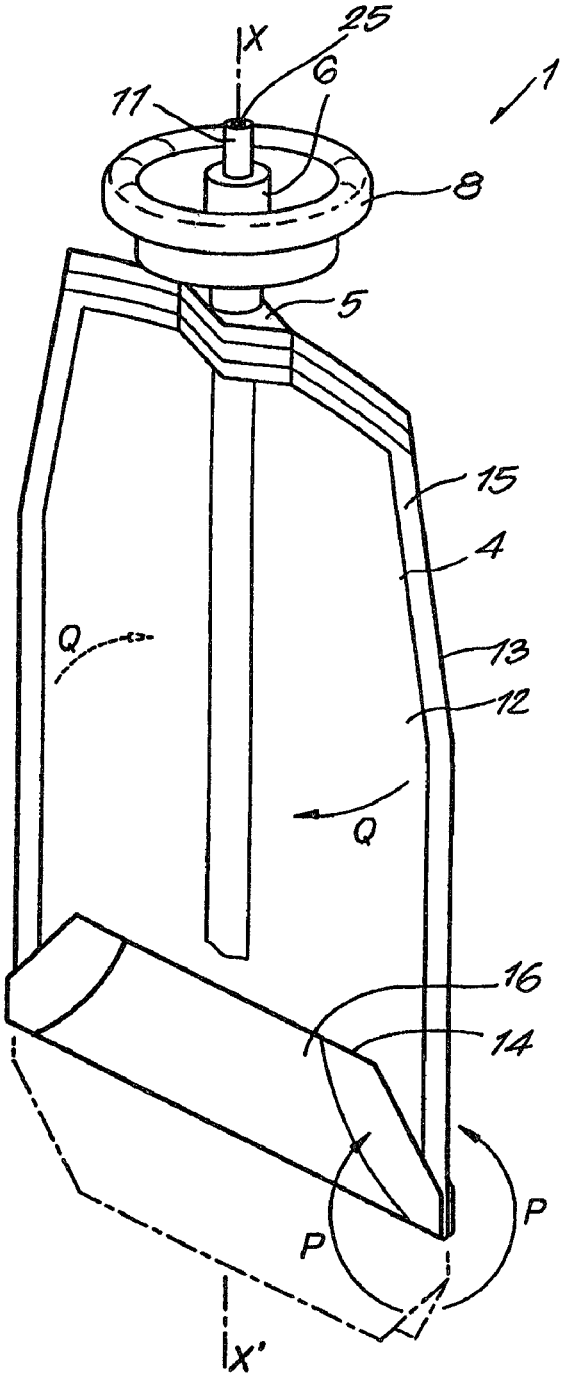
FIG. 8 represents another production phase of the bag-on valve according to FIG. 1.

As represented in greater detail in FIGS. 5 to 7, every bag-on valve is made of two impermeable synthetic layers 12 and 13 laid on top of one another and of a bottom 14 which is folded double and inserted between these two layers 12 and 13, whereby the two layers 12 and 13 and the bottom are welded together at their girths 15 in the area where they make contact, so as to form two flaps 16 which can be turned up to the outside as indicated by the arrows P.

In the case of the example of the figures, the two layers 12 and 13 and the bottom 14 are made in one piece, folded in a certain way, but the layers 12 and 13 and the bottom 14 may just as well be separate pieces that are welded together.

As illustrated in FIG. 4, the bags 4 are in principle made in series out of a folded continuous belt which is drawn under a welding machine which welds the girths 15 at well determined intervals in the area where the bags 4 are separated, whereby the weld seams have a shape which widens towards the top so as to form bags 4 whose upper part is conical, such that the width of the empty bag 4 diminishes towards the location of the valve 6.

After the welding, the bags 4 are separated by cutting them apart.

The thus separated bags 4 are then rolled round the axis x-x' in the direction of the arrows Q, after the flaps 16 have been turned down.

A label 7, or if necessary several labels, are then glued round every rolled-up bag so as to keep it rolled up as indicated in FIG. 1.

Figure 9:
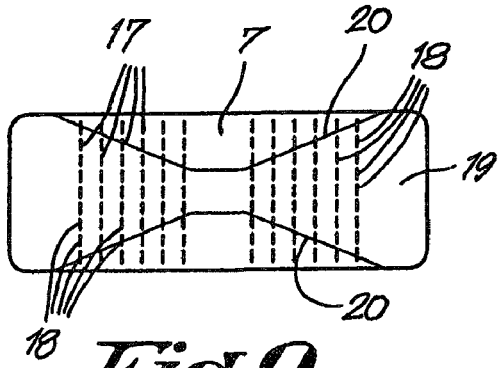
FIG. 9 represents the label indicated by F9 in FIG. 1, but unfolded.

As indicated in FIG. 9, the labels are rectangular and contain one or several transversal lines 17 with spaced perforations 18 which facilitate the tearing of the labels 7 while the bags 4 are being filled.

The label 7 is a self-adhesive label whose central part is only partially provided with an adhesive 19, for example because the adhesive 19 is provided in a zone 20 in the shape of a sandglass, counter sandglass or any other shape.

Figure 10:
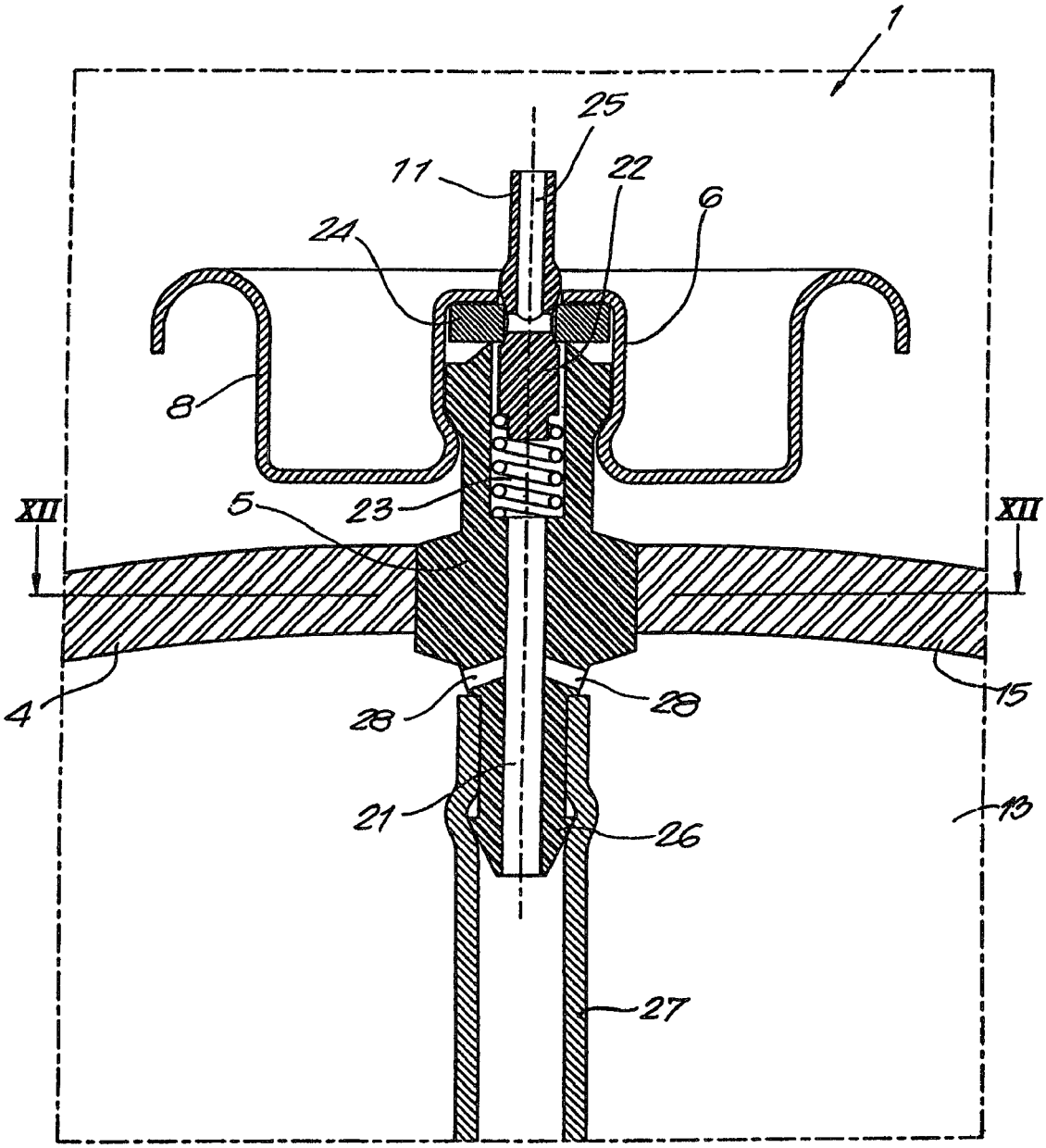
FIG. 10 represents the part indicated by F10 in FIG. 6 to a larger scale.
Figure 11:
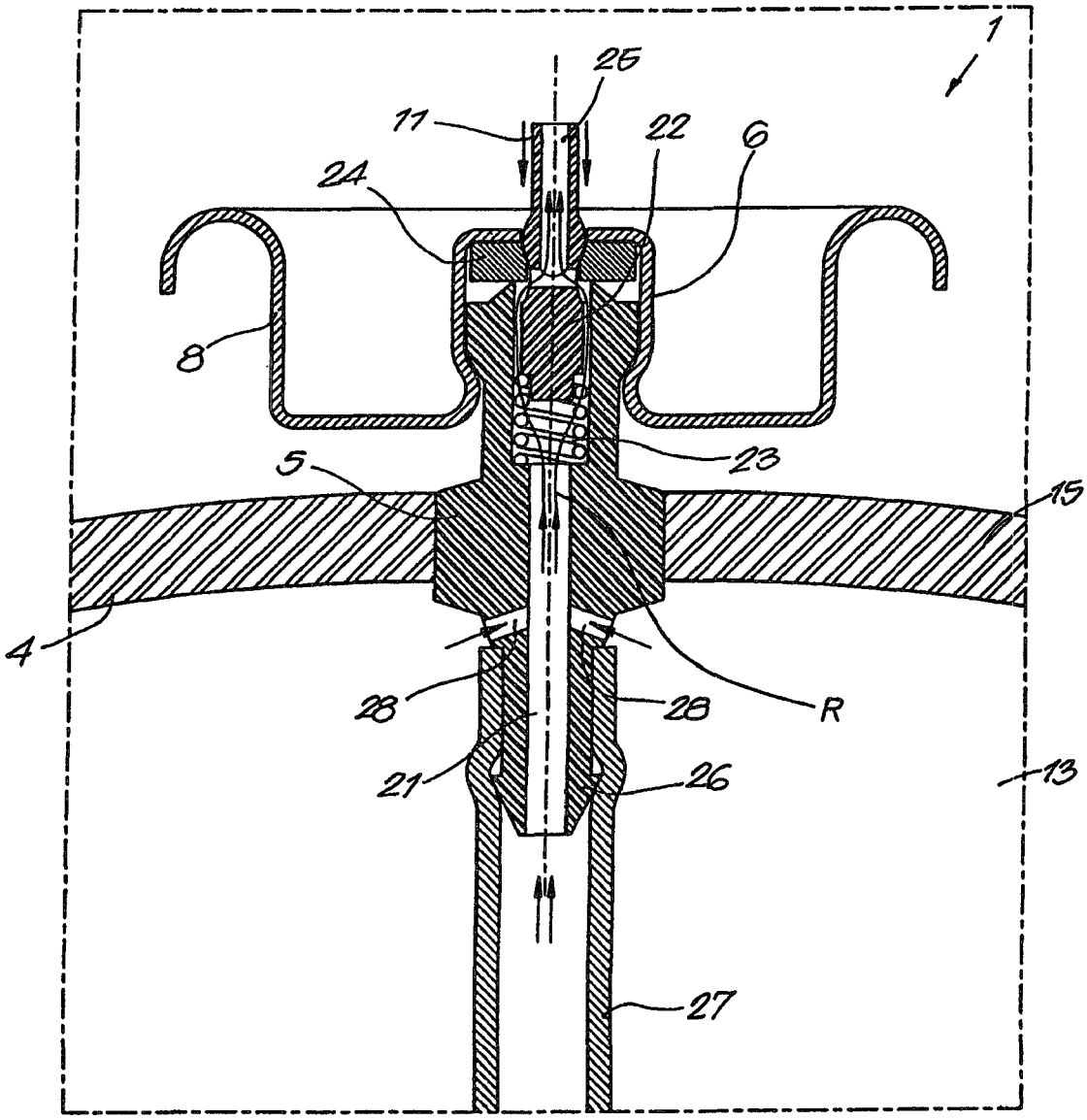
FIG. 11 represents the same view as that of FIG. 10, but in another position.
Figure 12:
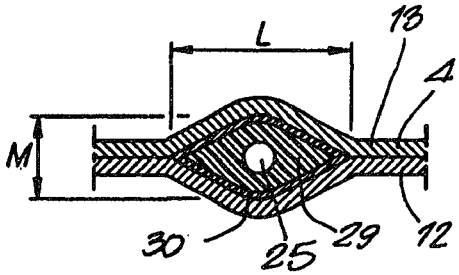
FIG. 12 is a section according to line XII-XII of FIG. 10.

The construction of the valve 6 is shown in greater detail in FIGS. 10 to 12.

The body 5 of the valve 6 is characterised by an oval or diamond-shaped contour whose length L is preferably at least the double of the width M of the contour as indicated in FIG. 12.

The valve 6 comprises a passage 21 to evacuate the product out of the bag 4, to the outside, whereby the passage 21 can be stopped up by a valve 22 situated in a chamber 23 formed of a part of the passage 21 with a larger diameter and whose stem 11 protrudes outwards through a joint 24.

In rest, the valve 22 is maintained against the joint 24 as indicated in FIG. 10, such that an internal passage 25 of the valve 22 is stopped up in this position, whereas the passage 25 is open when the stem 11 of the valve 22 is driven in so as to make the product leave via the passage 21 of the valve 6 as indicated by the arrows R in FIG. 11.

The valve 6 is preferably equipped with a tip 26 on which is inserted a plunger tube 27 which communicates with the passage 21 of the valve 6 and whose length is shorter than or is approximately the same as the length of the bag 4.

In the example of the drawings, the valve 6 is provided with a second passage 28 which communicates with the inside of the bag 4, whereby this passage 28 opens in the bag 4 above the level of the tip 26.

These two passages 21 and 28 make it possible to fill the bag 4 faster with a product.

According to a particular characteristic of the invention, the body 5 of the valve 6 comprises an inner part 29 and an outer part 30 as represented in FIG. 12, whereby the two parts 29 and 30 are made of two different materials, i.e. an inner part 29 made of a synthetic material which is impermeable to liquefied gases, and an outer part 30 made of a material which is fit for using a bag 4 whose inner coating is made of PE or PP or other materials that can be welded.

The use of a bag-on valve 1 according to the invention for realising a product distributor is as follows.

The rolled-up bag-on valve 1 is introduced, the gas is introduced above and around the valve, after which the valve is fixed in the recipient 2 so as to seal the recipient. The gas can also be injected in the recipient in the direction of a synthetic plug, valve or the like, situated at the bottom of the recipient.

Next, a well determined quantity of product to be distributed is injected under pressure in the bag 4 via the passages 21 and 28 which allow for a quick filling of the bag 4.

As a result of the injection pressure, the bag 4 swells and tears the label 7 where the lines 17 of the perforations 18 are situated.

The bag 4 is unrolled in the opposite sense of the arrows Q, whereas the flaps 16 are filled with the product and are unfolded to the outside, towards the bottom, thus allowing the bag 4 to extend in relation to its initial length, such that the bottom 14 will rest on the bottom 31 of the recipient 2.

The dimensions and shape of the bag-on valve 1 are preferably such that the empty bag-on valve 1 does not reach the bottom 31 of the recipient 2 when it is mounted in the recipient and such that the bag 4 of the bag-on valve 1 rests on the bottom 31 of the recipient 2 when the bag 4 has been filled.

Thus, the introduction of the empty bag-on valve in the recipient is not hindered by the length of the bag-on valve.

Indeed, a rolled-up or folded-up bag 1 has a certain rigidity which might hinder the introduction of the bag-on valve 1 in the recipient 2 if the latter were longer than the depth of the recipient, for in this case the bag-on valve 1 would hit the bottom of the recipient while being mounted. Also the bag-on valve might be damaged.

Thanks to the design of the label 7 and the conical shape of the bag 4, the unrolling of the bag 4 is practically not hindered by the label or by the rubbing of the bag 4 against the inner wall of the recipient 2.

Figure 13:
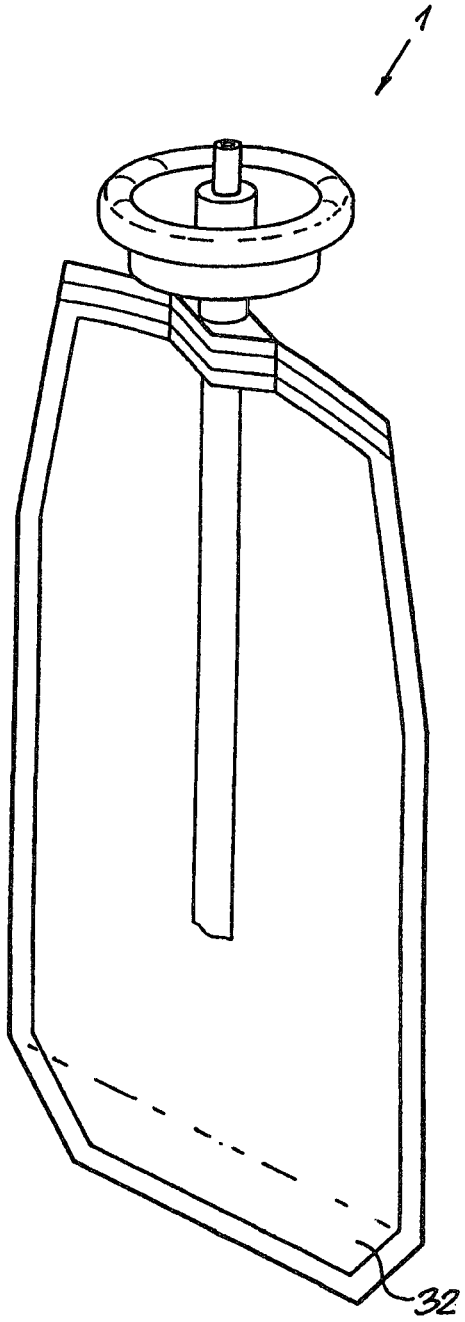
FIGS. 13 and 14 represent a different embodiment of a bag-on valve according to the invention.
Figure 14:
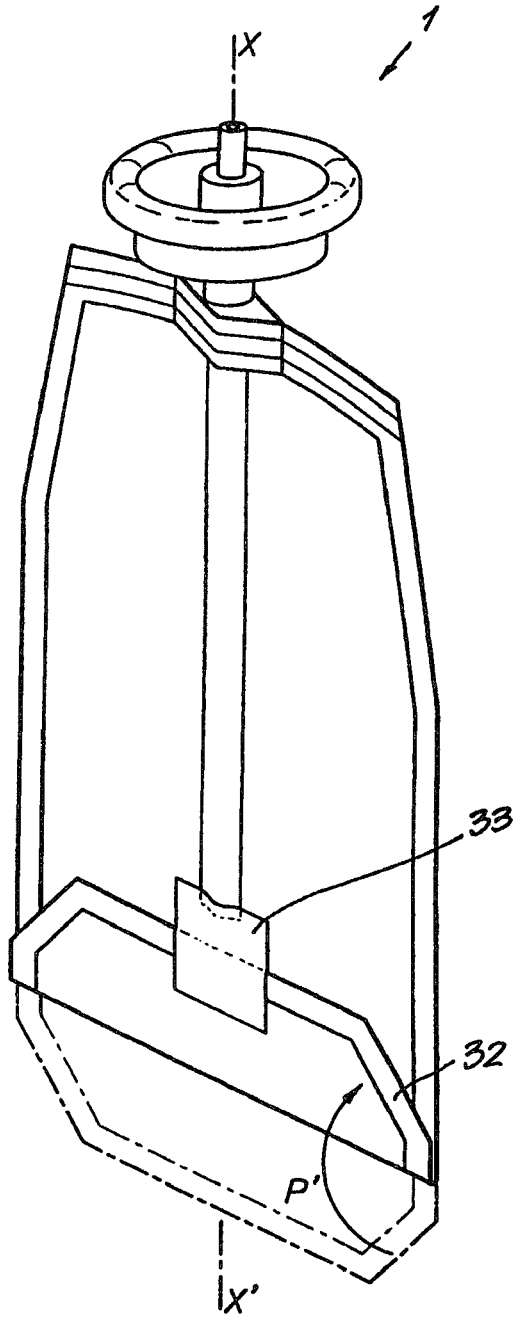

FIG. 14 shows a variant of a bag-on valve 1 according to the invention which is obtained from the bag-on valve in FIG. 13 which represents a bag-on valve with two layers 12 and 13 placed on top of one another and which are welded together at their girths 15, and whose lower free end is folded double like a flap 32, as represented by means of the arrow P' in FIG. 14, so as to reduce the length of the empty bag-on valve 1 and which is then rolled up or folded in the same manner as in the preceding figures.

The thus folded flap 32 can for example be maintained in position with a label 33 which has for example the same characteristics as a label 7.

When such a bag-on valve 1 is filled, the folded flap 32 will be unfolded in the opposite sense so as to rest on the bottom 31 of the recipient, while tearing the label 33.

It is clear that the invention is by no means restricted to the above-described examples, but that numerous modifications can be made to the above-described bag-on valve while still remaining within the scope of the invention as described in the following claims.

The invention claimed is:

1. An improved bag-on valve which comprises a flexible bag made of impermeable material and which is provided with an opening sealed by a valve which makes it possible to fill the bag with a desired product, whereby the empty bag is rolled up or folded round a longitudinal axis and is maintained in the rolled-up position, wherein the bag is provided with means making it possible to elongate the bag while it is being filled with the desired product, and the means making it possible to elongate the bag comprise a flap which is realized by folding upwards the free end of the bag before rolling-up or folding of the empty bag round a longitudinal axis.

2. The bag-on valve according to claim 1, wherein a bottom is provided on the bag, the bottom being folded towards inside of the empty bag, thus forming flaps which are folded upwards before rolling-up or folding of the empty bag round a longitudinal axis.

3. The bag-on valve according to claim 2, wherein the bag is made of two layers laid on top of one another and of a bottom which is folded double and which is inserted between these two layers, whereby the two layers and the bottom are welded together at their girths in the area where they make contact, so as to form two flaps which can be folded upwards.

4. The bag-on valve according to claim 1, wherein the shape of the upper part of the empty and unrolled bag is conical, such that the width of the empty bag diminishes towards the location of the valve.

5. The bag-on valve according to claim 1, wherein the bag of the empty bag-on valve is kept rolled up or folded up by means of a label which is glued around it.

6. The bag-on valve according to claim 5, wherein the label contains one or several transversal lines with spaced perforations.

7. The bag-on valve according to claim 5, wherein the label is a rectangular self-adhesive label whose central part is only partially provided with an adhesive.

8. The bag-on valve according to claim 7, wherein the adhesive is provided in a zone having the shape of a sandglass or a counter sandglass.

9. The bag-on valve according to claim 1, wherein it comprises a plunger tube.

10. The bag-on valve according to claim 9, wherein the valve is provided with a tip for fixing the plunger tube.

11. The bag-on valve according to claim 9, wherein the length of the plunger tube corresponds more or less to the length of the bag.

12. The bag-on valve according to claim 10, wherein the valve is provided with two passages which communicate with the inside of the bag, namely one passage which opens in the plunger tube, whereby the other passage opens in the bag above the above-mentioned tip.

13. The bag-on valve according to claim 1, wherein the body contour of the valve is oval or diamond-shaped with a length that is as small as possible, but at least the double of the width of the contour.

14. The bag-on valve according to claim 1, wherein the body of the valve comprises an inner part and an outer part, whereby both parts are made of two different materials, i.e. the inner part of a synthetic material which is impermeable to liquefied gases, and the outer part of a material which is fit for the welding of the inner coating of the bag made of PE or PP or other materials which can be welded or glued.

15. The bag-on valve according to claim 1, wherein the dimensions and the shape of the bag-on valve are such that the empty bag-on valve does not touch the bottom of the recipient when it is mounted in the recipient and in that the bag of the bag-on valve rests on the bottom of the recipient when the bag has been filled.

16. The bag-on valve according to claim 1, wherein the flap is kept in place by a label.

* * * * *